US011560649B2

(12) United States Patent
Callaghan

(10) Patent No.: US 11,560,649 B2
(45) Date of Patent: Jan. 24, 2023

(54) WOVEN TEXTILE AND ASSOCIATED METHOD OF MANUFACTURE

(71) Applicant: JAMES DEWHURST LIMITED, Lancashire (GB)

(72) Inventor: Sean Anthony Callaghan, Wigan (GB)

(73) Assignee: James Dewhurst Limited, Lancashire (GB)

( * ) Notice: Subject to any disclaimer, the term of this patent is extended or adjusted under 35 U.S.C. 154(b) by 0 days.

(21) Appl. No.: 16/976,342

(22) PCT Filed: Feb. 28, 2019

(86) PCT No.: PCT/GB2019/050552

§ 371 (c)(1),
(2) Date: Aug. 27, 2020

(87) PCT Pub. No.: WO2019/166807

PCT Pub. Date: Sep. 6, 2019

(65) Prior Publication Data

US 2021/0363671 A1 Nov. 25, 2021

(30) Foreign Application Priority Data

Mar. 1, 2018 (GB) ..... 1803369

(51) Int. Cl.
*D03D 13/00* (2006.01)
*D03D 5/00* (2006.01)
(Continued)

(52) U.S. Cl.
CPC ..... *D03D 5/00* (2013.01); *D03D 11/00* (2013.01); *D03D 13/00* (2013.01); *D03D 13/008* (2013.01);
(Continued)

(58) Field of Classification Search
CPC ..... D03D 5/00; D03D 13/008; D03D 15/41; D03D 15/283; D03D 11/00; D03D 15/587; D10B 2321/021; D10B 2321/022
See application file for complete search history.

(56) References Cited

U.S. PATENT DOCUMENTS 621,312 A * 3/1899 Algeo ..... D03D 5/00 139/385
2,400,327 A * 5/1946 Womble ..... D03D 5/00 139/426 R
(Continued)

FOREIGN PATENT DOCUMENTS

DE 3330900 A * 3/1985 ..... D03D 47/46
DE 3330900 A1 3/1985
(Continued)

OTHER PUBLICATIONS

Thread, (n.d.) American Heritage® Dictionary of the English Language, Fifth Edition. (2011). Retrieved Oct. 13, 2021 from https://www.thefreedictionary.com/thread (Year: 2011).*
(Continued)

*Primary Examiner* — Robert H Muromoto, Jr.
(74) *Attorney, Agent, or Firm* — Taft Stettinius & Hollister LLP; Stephen F. Rost

(57) ABSTRACT

There is provided a method of manufacturing a woven textile, in which a plurality of warp yarns is interlaced with a plurality of weft yarns. A selvedge is formed by interlacing a first subset of the warp yarns with a first subset of the weft yarns and interlacing a second subset of the warp yarns with a second subset of the weft yarns. The first subset of the warp yarns is not interlaced with the second subset of the weft yarns and the second subset of the warp yarns is not interlaced with the first subset of the weft yarns. The method may be used to manufacture a multilayer textile.

12 Claims, 2 Drawing Sheets

(51) Int. Cl.
*D03D 15/283* (2021.01)
*D03D 15/41* (2021.01)
*D03D 15/587* (2021.01)
*D03D 11/00* (2006.01)

(52) U.S. Cl.
CPC ..... *D03D 15/283* (2021.01); *D03D 15/41* (2021.01); *D03D 15/587* (2021.01); *D10B 2321/021* (2013.01); *D10B 2321/022* (2013.01)

(56) References Cited

U.S. PATENT DOCUMENTS 3,610,292 A * 10/1971 Wasyleviez ..... G05D 23/24 139/434
3,741,256 A * 6/1973 Wesseler ..... D03C 7/00 139/54
3,795,261 A * 3/1974 Serturini ..... D03D 47/40 139/54
3,841,358 A * 10/1974 Svaty ..... D03C 7/00 139/54
3,945,406 A * 3/1976 Wueger ..... D03C 7/08 139/54
3,952,778 A * 4/1976 Volpe ..... D03C 7/06 139/54
3,998,247 A * 12/1976 Kovar ..... D03C 7/08 139/54
4,066,105 A * 1/1978 Heinrich ..... D03C 7/06 139/54
4,108,213 A * 8/1978 Guttinger ..... D03C 7/06 139/54
4,160,057 A * 7/1979 Kogan ..... B65D 63/10 428/193
4,166,480 A * 9/1979 Muller ..... D03C 7/08 139/54
4,299,257 A * 11/1981 Kinoshita ..... D03D 47/40 139/54
4,421,141 A * 12/1983 Brouwer ..... D03D 47/40 139/54
4,445,544 A * 5/1984 Krumm ..... D03C 7/06 139/54
4,453,572 A * 6/1984 Key ..... D03D 45/62 139/291 C
4,498,504 A * 2/1985 Allen ..... D03D 47/125 139/194
4,513,791 A * 4/1985 Dillon ..... D03D 45/62 139/194
4,520,850 A * 6/1985 Cramer ..... D03D 47/40 139/194
4,580,605 A * 4/1986 Gosciniak ..... D03C 7/06 139/430
4,691,743 A * 9/1987 Venot ..... D03J 1/002 139/291 C
4,967,802 A * 11/1990 Klocker ..... D03C 7/02 139/51
5,099,554 A * 3/1992 Cooper ..... D04H 3/045 28/102
5,172,458 A * 12/1992 Cooper ..... D04H 3/04 156/440
5,988,228 A * 11/1999 Krumm ..... D03C 7/08 139/54
5,996,647 A * 12/1999 Krumm ..... D03C 7/04 139/54
6,009,916 A * 1/2000 Krumm ..... D03C 7/04 139/54
6,039,086 A * 3/2000 Dornier ..... D03C 7/04 139/302
6,102,082 A * 8/2000 Hehle ..... D03J 1/08 139/302
6,240,974 B1 * 6/2001 Hehle ..... D03D 47/40 139/106
6,376,047 B1 * 4/2002 Hasegawa ..... D03D 15/593 428/193
6,675,837 B1 * 1/2004 Russ ..... D03D 47/308 139/11
7,841,369 B1 * 11/2010 Osborne ..... A41D 13/0012 139/421
9,211,865 B2 * 12/2015 Furuniwa ..... D03D 1/02
9,359,698 B2 * 6/2016 Shimazaki ..... D03C 7/00
10,039,640 B2 * 8/2018 Grundeman ..... A61F 2/2412
10,583,003 B2 * 3/2020 Grundeman ..... A61F 2/2412
2004/0050506 A1 3/2004 Haiber et al.
2005/0051229 A1 * 3/2005 DeMoore ..... D03D 5/00 139/383 R
2006/0016506 A1 * 1/2006 Okawa ..... A44B 18/0023 139/383 R
2006/0254665 A1 * 11/2006 Glorie ..... D03C 7/06 139/54
2014/0232165 A1 * 8/2014 Brielmann ..... D03D 13/004 297/468
2017/0121866 A1 * 5/2017 Hockemeyer ..... H02K 5/04

FOREIGN PATENT DOCUMENTS

GB 1525963 A 9/1978
GB 2062035 A 5/1981
WO 2003106746 A1 12/2003

OTHER PUBLICATIONS

International Search Report & Written Opinion, European Patent Office, 10 pages, dated May 9, 2019.
Decision of Rejection, State Intellectual Property Office of People's Republic of China, CN201980028924.3, 4 pages, dated Jul. 29, 2022.
European Patent Office (EPO); Examination Report of corresponding application No. EP19710090.2; dated Jul. 19, 2022; pp. 4.
UK Intellectual Property Office (UKIPO); Examination Report of corresponding application No. GB1803369.6; dated Jun. 28, 2022; pp. 4.

* cited by examiner

WOVEN TEXTILE AND ASSOCIATED METHOD OF MANUFACTURE

This application is a U.S. national stage application under 35 U.S.C. § 371 of PCT International Application Serial No. PCT/GB2019/050552, which has an international filing date of Feb. 28, 2019, designates the United States of America, and claims the benefit of GB Application. No. 1803369.6, which was filed on Mar. 1, 2018 the disclosures of which are hereby expressly incorporated by reference in their entirety.

TECHNICAL FIELD

The invention relates to a woven textile and to an associated method of manufacturing a woven textile.

BACKGROUND

Modern textile manufacturers develop innovative and high quality textiles, extending the use of textiles beyond conventional uses such as clothing and furnishings. Textiles are now commonly found in a broad spectrum of applications, including applications in the automotive and aeronautical industries, agriculture, construction, packaging, healthcare and security. Such applications have established the production of textiles that incorporate high-performance yarns and tapes, the properties of which allows for the development and creation of novel and innovative products and uses. One such use of textiles, across a variety of applications, is in thermoformable preforms (sheets of material that are heatable to a pliable forming temperature and formable to a specific shape in a mould) to produce thermoformed articles. Typically, using a textile in a thermoformable preform helps to inhibit undesirable thinning of one region of a thermoformed article relative to another region thereof, as well as provide the thermoformed article with the inherent properties of the textile. However, in order to provide the desired properties, e.g. weight, strength and/or thickness, of a given thermoformed article, it is often necessary to provide multiple, laminated sheets of a textile. Thermoformed articles comprising laminated sheets of material are vulnerable to mechanical failure, e.g. by delamination, as a result of impact or deformation.

It is an object of embodiments of the invention to at least mitigate one or more problems associated with known arrangements.

SUMMARY OF THE INVENTION

Aspects and embodiments of the invention provide a method of manufacturing a woven textile, a woven textile, a thermoformable article, a method of manufacturing a thermoformed article and a thermoformed article as recited in the appended claims.

According to an aspect of the invention, there is provided a method of manufacturing a woven textile. The method comprises interlacing a plurality of warp yarns with a plurality of weft yarns. The method may further comprise forming a selvedge by interlacing a first subset of the warp yarns with a first subset of the weft yarns and interlacing a second subset of the warp yarns with a second subset of the weft yarns, wherein the first subset of the warp yarns is not interlaced with the second subset of the weft yarns and the second subset of the warp yarns is not interlaced with the first subset of the weft yarns. The method may provide a woven textile having improved strength and or durability, compared to known woven textiles.

In certain embodiments, one or more of the warp yarns may comprise one or more first threads, each of the first threads being one of a yarn (e.g. a multifilament yarn, a monofilament yarn, a spun yarn or a texturised yarn) and a tape. The method may further comprise combining, e.g. by twisting together, two or more of the first threads to form each of the one or more of the warp yarns, i.e. forming one or more of the warp yarns as plied yarns. One or more of the first threads may each have a width no greater than 15 wraps per inch. One or more of the first threads may each have a width of at least 4 wraps per inch and/or no greater than 30 wraps per inch.

Additionally, or alternatively, one or more of the weft yarns may comprise one or more second threads, each of the second threads being one of a yarn (e.g. a multifilament yarn, a monofilament yarn, a spun yarn or a texturised yarn) and a tape. The method may further comprise combining, e.g. by twisting together, two or more of the second threads to form each of the one or more of the weft yarns, i.e. forming one or more of the weft yarns as plied yarns. One or more of the second threads may each have a width no greater than 15 wraps per inch. One or more of the second threads may each have a width of at least 4 wraps per inch and/or no greater than 30 wraps per inch.

In certain embodiments, the method may further comprise interlacing the warp yarns with the weft yarns to form multiple layers of the warp yarns and/or the weft yarns, i.e. forming the woven textile as a multilayer woven textile. Forming the woven textile as a multilayer woven textile may comprise interlacing the one or more yarn systems of the warp yarns with two or more yarn systems of the weft yarns. Additionally, or alternatively, forming the woven textile as a multilayer woven textile may comprise interlacing the one or more yarn systems of the weft yarns with two or more yarn systems of the warp yarns.

Optionally, the method may further comprise interlacing the warp yarns with the weft yarns at a density of at least 5 ends per inch. The method may comprise interlacing the warp yarns with the weft yarns at a density of at least 4 ends per inch and/or no greater than 80 ends per inch. Additionally, or alternatively, the method may further comprise interlacing the warp yarns with the weft yarns at a density of at least 5 picks per inch. The method may comprise interlacing the warp yarns with the weft yarns at a density of at least 4 picks per inch and/or no greater than 80 picks per inch.

Optionally, one or more of warp yarns may have a width of no greater than 15 wraps per inch. One or more of the warp yarns may have a width of at least 8 wraps per inch and/or no greater than 105 wraps per inch. Additionally, or alternatively, the one or more of weft yarns may have a width no greater than 15 wraps per inch. One or more of the weft yarns may have a width of at least 8 wraps per inch and/or no greater than 105 wraps per inch.

In certain embodiments, the method may further comprise forming the selvedge along an edge of the woven textile. One or more of the warp yarns and/or one or more of the weft yarns may comprise a low melt material, the low melt material being meltable to bond at least a portion of the warp yarns and/or at least a portion of the weft yarns to one another. The low melt material may comprise at least one of a polyethylene (e.g. a high-density or an ultra-high-density polyethylene) and a polypropylene (e.g. a high-density or an ultra-high-density polypropylene).

The method may further comprise interlacing the warp yarns with the weft yarns having the weave shown in FIG. 2 of the accompanying figures.

According to an aspect of the invention, there is provided a woven textile comprising a plurality of warp yarns interlaced with a plurality of weft yarns, one or more of the warp yarns and/or one or more of the weft yarns comprising one or more threads. The woven textile may be obtainable by the above-described method.

In certain embodiments, one or more the threads may be one of a yarn (e.g. a multifilament yarn or a monofilament yarn) and a tape. One or more of the warp yarns and/or one or more of the weft yarns may be a plied yarn comprising two or more of the threads combined with one another. One of more of the threads may each have a width no greater than 15 wraps per inch. One or more of the threads may each have a width of at least 4 wraps per inch and/or no greater than 30 wraps per inch.

In certain embodiments, the woven textile may be a multilayer woven textile comprising multiple layers of weft yarns. The multilayer woven textile may comprise multiple layers of the warp yarns and/or multiple layers of the weft yarns interlaced with one another. Each of the multiple layers of the warp and/or weft yarns may be formed by a respective yarn system of the warp and or/weft yarns. Thus, in certain embodiments, the warp yarns may comprise two or more yarn systems. Additionally, or alternatively, the weft yarns may comprise two or more yarn systems.

The woven textile may have a density of at least 5 ends per inch. The woven textile may have a density of at least 4 ends per inch and/or no greater than 80 ends per inch Additionally, or alternatively, the woven textile may have a density of at least 5 picks per inch. The woven textile may have a density of at least 4 picks per inch and/or no greater than 80 picks per inch.

Optionally, one or more of warp yarns may have a width no greater than 15 wraps per inch. One or more of the warp yarns may have a width of at least 8 wraps per inch and/or no greater than 105 wraps per inch. Additionally, or alternatively, one or more of the weft yarns may have a width no greater than 15 wraps per inch. One or more of the weft yarns may have a width of at least 8 wraps per inch and/or no greater than 105 wraps per inch.

Additionally, or alternatively, one or more of the warp yarns and/or one or more of the weft yarns may comprise a low melt material, the low melt material being meltable to bond at least a portion of the warp yarns and/or at least a portion of the weft yarns to one another. The low melt material may comprise at least one of a polyethylene (e.g. a high-density or an ultra-high-density polyethylene) and a polypropylene (e.g. a high-density or an ultra-high-density polypropylene).

According to an aspect of the invention, there is provided a thermoformable article, e.g. a thermoformable preform, comprising a woven textile as described above and/or comprising a woven textile manufactured as described above.

According to an aspect of the invention, there is provided a method of manufacturing a thermoformed article. The method may comprise supplying a thermoformable article as described above, feeding the thermoformable article into a press and forming the thermoformable article in the press while the thermoformable article is in semi-molten state to form the thermoformed article. Forming the thermoformable article may comprise heating and/or cooling the thermoformable article.

According to an aspect of the invention, there is provided a thermoformed article comprising or formed from the thermoformable article as described above. In certain embodiments, the thermoformed article may be free, or at least substantially free, of a resin matrix. In certain embodiments, the thermoformed article may be a shell for a suitcase.

BRIEF DESCRIPTION OF THE DRAWINGS

Embodiments of the invention will now be described, by way of example only, with reference to the accompanying figures, in which.

DETAILED DESCRIPTION

Figure 1:
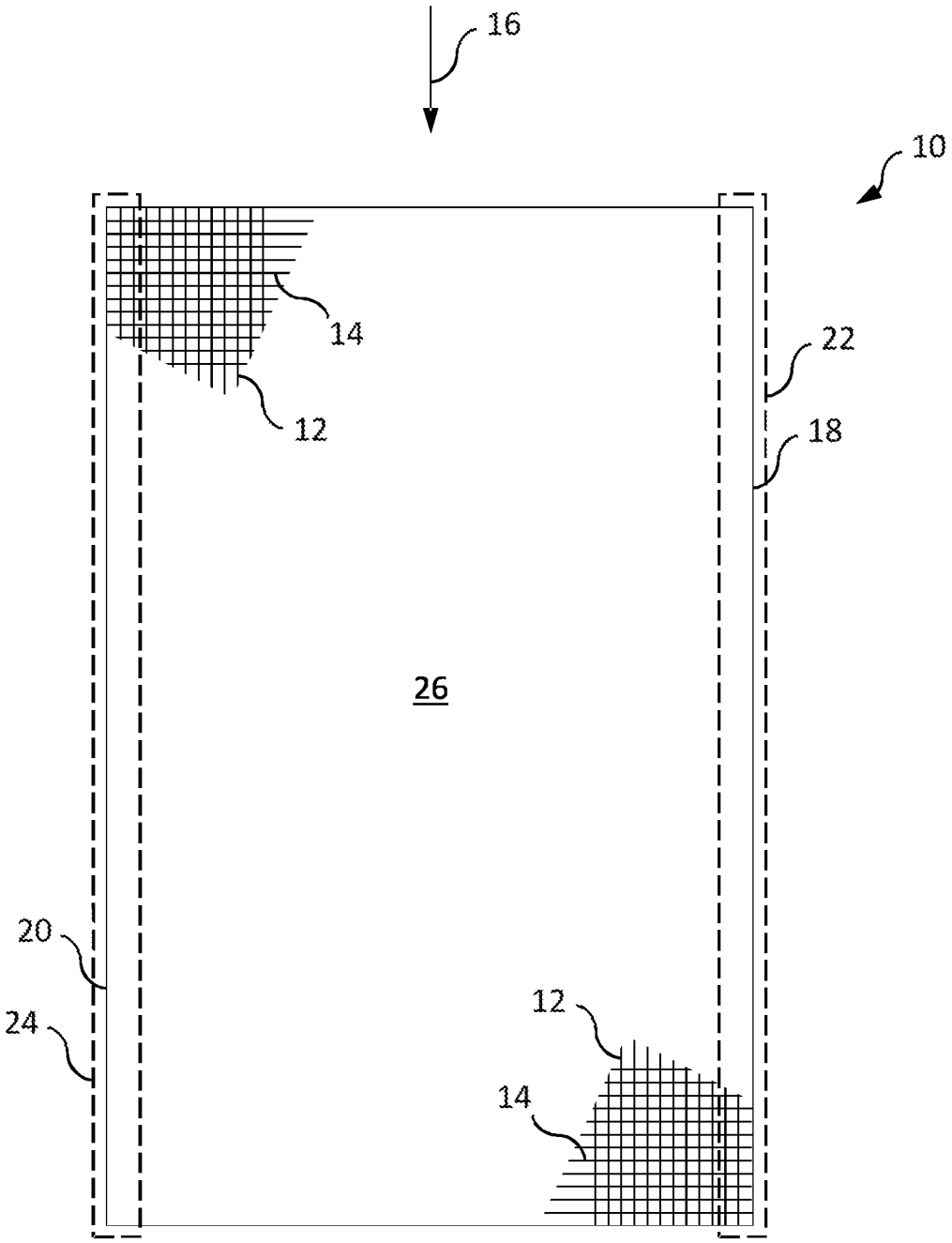
FIG. 1 is a schematic representation of a woven textile according to an embodiment of the invention.

FIG. 1 shows a woven textile 10 according to an embodiment of the invention. The textile 10 has particular application in preforms for use in thermoforming. However, other applications are contemplated, e.g. composite forming. The textile 10 comprises a plurality of warp yarns 12 interlaced with a plurality of weft yarns 14. As is conventional, the warp yarns 12 run in a longitudinal direction, i.e. in a manufacturing direction 16, and the weft yarns 14 run in a lateral direction, i.e. substantially perpendicular to the manufacturing direction 16. As shown in FIG. 1, the weft yarns 14 may extend between opposing edges 18, 20 of the textile 10.

The textile 10 may further comprise one or more selvedges 22, 24. Each of the selvedges 22, 24 may form one of the opposing edges 18, 20 of the textile 10, between which may extend a main body 26 of the textile 10. As the skilled reader will appreciate, the selvedges 22, 24 may be incorporated into the textile 10 to prevent fraying of the textile 10 and/or to stabilise the warp and weft yarns 12, 14, at least during manufacture of the textile 10. In certain embodiments, the main body 26 may form or constitute a finished or a semi-finished product, e.g. thermoformable preform. As such, each of the selvedges 22, 24 may be removed and discarded. Removal of one of more of the selvedges 22, 24 may occur during or after manufacture of the woven textile 10, e.g. by severing the weft yarns 14 extending between each of the selvedge 22, 24 and the main body 26.

Each of the warp and/or weft yarns 12, 14 may comprise one or more threads. The term thread used herein (including in the appended claims) is to be understood to mean individual elements, e.g. yarns or tapes, that the warp and/or weft yarns 12, 14 may comprise. As such, the term thread is not to be understood to be limited to a twisted strand of cotton or similar. Thus, in certain embodiments, each of the warp and/or weft yarns 12, 14 may be formed by one individual yarn or tape. While each of the threads may be any suitable thread, each of the threads may be a monofilament yarn, a multifilament yarn, a spun yarn or a texturised yarn. In certain embodiments, each of the threads may be an extruded tape, a pressed tape or a calendared tape. The number of threads in the textile 10 may be expressed in ends per inch and picks per inch. Ends per inch is a measure of the threads running in the longitudinal direction (i.e. number of warp threads) and picks per inch is a measure of the threads running in the lateral direction (i.e. number of weft threads).

Of course, the number of ends per inch and picks per inch will vary depending upon the width (i.e. thickness) of the threads. While the thickness of each of the threads is usually expressed as a measure of linear mass density, e.g. tex, it may be measured in wraps per inch. Wraps per inch may be measured by counting the number of times one of the threads can be wrapped around an object, e.g. a ruler, in adjacent turns over an inch. By way of example, a 3 mm wide tape provides approximately 8.5 wraps per inch. As well as being a measure of the width of each of the threads, wraps per inch may also be used as a measure of the width (i.e. thickness) of each of the warp and/or weft yarns 12, 14.

While the exact width of each of the threads may vary, as any suitable width may be used, at least some of the threads (including "first threads" and "second threads" recited in the appended claims) may have a width of no greater than 10 wraps per inch. Alternatively, at least some of the threads may have a width of no greater than 5 wraps per inch or no greater than 3 wraps per inch. For the avoidance of doubt, 10, 5 and 3 wraps per inch correspond to widths/diameters of approximately 2.5 mm, 5.0 mm and 8.7 mm, respectively. Thus, no more than 10 wraps per inch corresponds to at least approximately 2.5 mm.

As the skilled reader will appreciate, each of the warp and/or weft yarns 12, 14 comprising two or more of the threads may be termed a plied yarn. Combining multiple threads with one another may facilitate an increase in the ends per inch and/or the picks per inch. A plied yarn comprising two of the threads (i.e. two plies) contributes two ends to the number of ends per inch. Advantageously, a plied yarn may have a lower number of wraps per inch that the sum of the wraps per inch of each of the individual threads that the plied yarn comprises. This is particularly true of plied yarns comprising one or more tapes. Thus, in certain embodiments, each of the warp and or weft yarns 12, 14 may comprise a respective plied yarn formed by combining two or more of the threads. Combining two or more of the threads may be by twisting together the threads. The twisting together of two of more of the threads may incorporate a "S" twist and/or a "Z" twist. Of course, the amount of twisting may be variable. In certain embodiments, each of warp and/or weft yarns may comprise two or more of the threads having between 10 and 500 twists per metre.

Advantageously, combining two or more threads with one another may allow an increase in the weight of the textile 10. Heavyweight textiles are generally considered to be those having a weight of at least 350 gsm. However, in certain applications, it is not uncommon to require weights of at least 500 gsm. Heavyweight textiles typically require a high number of ends per inch and/or picks per inch. However, achieving such high weights (i.e. high numbers of picks per inch and/or ends per inch) is often impractical, if not impossible, particularly when weaving threads having a low number of wraps per inch, e.g. tapes. By combining two or more of the threads, as described above, the number of ends per inch and/or picks per inch may by increased, which may increase the weight of the textile 10. Moreover, by combining two or more of the threads the strength and/or durability of the textile may be increased.

At least some of the warp and/or weft yarns 12, 14 may have a width no greater than 105 wraps per inch. At least some of the warp and/or weft yarns 12, 14 may have a width no greater than 55 wraps per inch. At least some of the warp and/or weft yarns 12, 14 may have a width no greater than 15 wraps per inch. At least some of the warp and/or weft yarns 12, 14 may have a width no greater than 8 wraps per inch. However, and suitable width of the warp and/or weft yarns 12, 14 may be used.

The number of ends per inch and/or picks per inch will also vary depending upon the weave of the textile 10. Of course, the weave of the textile 10 is determined by the order in which the warp and weft yarns 12, 14 are interlaced with one another. The weave may impact upon the properties, e.g. strength, weight and/or drapability, of the textile 10. Thus, depending upon the properties of the warp and weft yarns 12, 14 and/or the intended application of the textile 10, any suitable weave may be used. In certain applications, the weave may be a plain weave. However, other weaves are contemplated, e.g. a satin weave or a basket weave. Of course, interlacing a plurality of warp yarns with a plurality of weft yarns does not necessarily result in each warp yarn being interlaced with each weft yarn.

Figure 2:
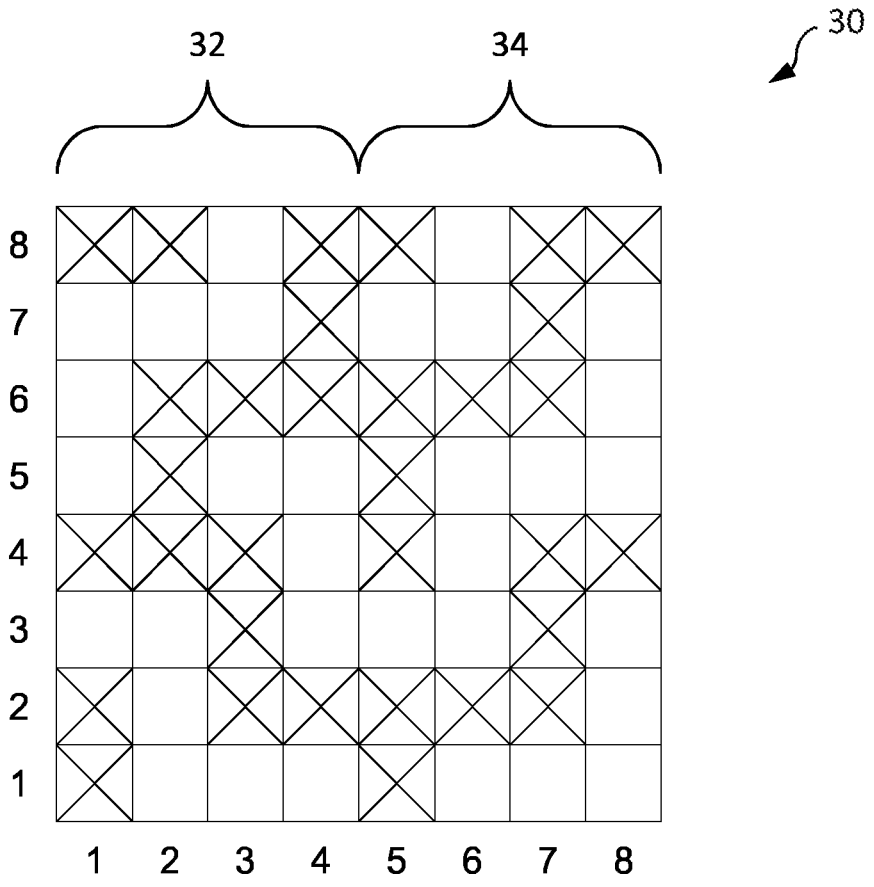
FIG. 2 is a weave diagram according to an embodiment of the invention, the weave diagram including a weave for a selvedge.

FIG. 2 shows an exemplary weave pattern 30 according to an embodiment of the invention. As the skilled reader will appreciate, each square shown in the weave pattern 30 represents a point at which the warp and the weft yarns 12, 14 are interlaced with one another. A square containing a "X" denotes a warp lift, i.e. one of the warp yarns 12 passing over one of the weft yarns 14. A blank square denotes a warp lowering, i.e. one of the warp yarns 12 passing under one of the weft yarns 14. As is conventional, the warp yarns 12 are numbered left to right and the weft yarns 14 are numbered from bottom to top.

The weave pattern 30 comprises a first part 32 and a second part 34. The first part is a weave pattern for forming the main body 26 of the textile 10. The second part 34 is a weave pattern for forming the one or more selvedges 22, 24 that are associated with the main body 26 formed using the first part 32. Of course, each of the one or more selvedges 22, 24 are formed together with the main body 26 during manufacture of the textile 10. Each of the one or more selvedges 22, 24 may comprise a weave that is the same or different to a weave of the main body 26. However, in FIG. 2, the weave of the first part 32 is different to that of the second part 34.

The weave pattern of the first part 32 is a compound weave, i.e. a weave pattern for manufacturing multilayer woven textiles. In certain embodiments, the textile 10 may be a multilayer woven textile. Thus, the textile 10 may comprise multiple layers of the warp and/or weft yarns 12, 14. As such, the textile 10 may comprise three or more yarn systems corresponding to the multiple layers of the warp and/or weft yarns 12, 14, e.g. the warp yarns 12 may comprise one yarn system and the weft yarns 14 may comprise two yarn systems, all of the yarn systems being interlaced with one another.

Certain embodiments may comprise further yarn systems, i.e. additional systems formed by the warp and or weft yarns 12, 14, which may allow for more complex weave patterns. Using a compound weave may allow an increase in the weight, strength and/or durability of the textile 10, as multiple layers of the warp and/or weft yarns 12, 14 may allow for an increase in the number of ends per inch and/or the picks per inch.

In certain embodiments, it may be difficult to form the one or more selvedges 22, 24, particularly when the textile 10 is a multilayer textile and/or the warp and/or the weft yarns 12, 14 have a low number wraps per inch, i.e. a large width/diameter. Difficulties may arise in capturing and/or holding the weft yarns 14 along the edges 18, 20 of the textile 10 during manufacture of the textile 10. Thus, in certain embodiments, each of the selvedge 22, 24 may be formed by interlacing a first subset of the warp yarns with a first subset of the weft yarns and interlacing a second subset of the warp yarns with a second subset of the weft yarns, essentially forming each of the selvedges 22, 24 as distinct bands of woven material, i.e. the first subset of the warp yarns is not interlaced with the second subset of the weft yarns and the second subset of the warp yarns is not interlaced with the first subset of the weft yarns. This may provide additional space in which to capture the weft yarns 14 along the edges 18, 20 of the textile 10 during manufacture of the textile 10.

The textile 10 may have any suitable density. However, the textile 10 may have a density of at least 10 ends per inch. The textile 10 may have a density of at least 40 ends per inch. The textile 10 may have a density of at least 60 ends per inch. The textile 10 may have a density of at least 60 ends per inch. Additionally, or alternatively, the textile 10 may have a density of at least 10 picks per inch. The textile 10 may have a density of at least 40 picks per inch. The textile 10 may have a density of at least 60 picks per inch. The textile 10 may have a density of at least 60 picks per inch. The warp yarns 12 for forming the one or more selvedges 22, 24 may be set up on separate shafts of a loom to the warp yarns 12 for forming the main body 26.

As described above, certain embodiments may be used as a thermoforming preform. To this end, the woven textile 10 may comprise a low melt material. More specifically, the warp and/or weft yarns 12, 14 may comprise a low melt material. The term low melt material used herein (including in the appended claims) is to be understood to mean a material with a relatively lower melting temperature than other materials that the warp and/or weft yarns 12, 14 may comprise. In any event, the low melt material may have a melting temperature of at least 100 and/or of no more than 250° C. During a method of thermoforming, the textile 10 may be heated to melt the low melt material to a semi-molten state before being formed.

Embodiments of the invention may negate the need for multiple, laminated sheets of a textile when manufacturing a thermoformed article. Thus, embodiments of the invention may reduce the risk of delamination of a thermoformed article.

All of the features disclosed in this specification (including any accompanying claims and figures) and/or all of the steps of any method or process so disclosed, may be combined in any combination, except combinations where at least some of such features and/or steps are mutually exclusive.

Each feature disclosed in this specification (including any accompanying claims and figures), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims and figures) or to any novel one, or any novel combination, of the steps of any method or process so disclosed. The claims should not be construed to cover merely the foregoing embodiments, but also any embodiments which fall within the scope of the claims.

The invention claimed is:

1. A method of manufacturing a woven textile, the method comprising:

interlacing a plurality of warp yarns with a plurality of weft yarns wherein one or more of the warp yarns comprises one or more first threads, each of the first threads being a tape and one or more of the weft yarns comprises one or more second threads, each of the second threads being a tape; and forming a selvedge as distinct bands of woven material by interlacing a first subset of the warp yarns with a first subset of the weft yarns and interlacing a second subset of the warp yarns with a second subset of the weft yarns, wherein the first subset of the warp yarns is not interlaced with the second subset of the weft yarns and the second subset of the warp yarns is not interlaced with the first subset of the weft yarns; and removing the selvedge by severing one or more of the weft yarns.

2. A method according to claim 1, comprising combining two or more of the first threads to form each of the one or more of the warp yarns.

3. A method according to claim 1, wherein the first threads each have a width of at least 1.7 mm.

4. A method according to claim 1, comprising combining two or more of the second threads to form each of the one or more of the weft yarns.

5. A method according to claim 1, wherein the second threads each have a width of at least 1.7 mm.

6. A method according to claim 1, comprising interlacing the warp yarns with the weft yarns to form multiple layers of the weft yarns.

7. A method according to claim 1, comprising interlacing the warp yarns with the weft yarns at a density of at least 5 ends per inch.

8. A method according to claim 1, comprising interlacing the warp yarns with the weft yarns at a density of at least 5 picks per inch.

9. A method according to claim 1, wherein one or more of warp yarns has a width of at least 1.7 mm.

10. A method according to claim 1, wherein one or more of weft yarns has a width of at least 1.7 mm.

11. A method according to claim 1, wherein one or more of the warp yarns and/or one or more of the weft yarns comprises a low melt material, the low melt material being meltable to bond at least a portion of the warp yarns and/or at least a portion of the weft yarns to one another.

12. A method according to claim 11, wherein the low melt material comprises at least one of a polyethylene and a polypropylene.

* * * * *